US009714656B2

(12) United States Patent
Murakami

(10) Patent No.: US 9,714,656 B2
(45) Date of Patent: Jul. 25, 2017

(54) ROTARY MACHINE AND COMPRESSOR

(71) Applicant: DAIKIN INDUSTRIES, LTD., Osaka-shi, Osaka (JP)

(72) Inventor: Yasuhiro Murakami, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 37 days.

(21) Appl. No.: 14/418,361

(22) PCT Filed: Jul. 30, 2013

(86) PCT No.: PCT/JP2013/070573

§ 371 (c)(1),
(2) Date: Jan. 29, 2015

(87) PCT Pub. No.: WO2014/021302

PCT Pub. Date: Feb. 6, 2014

(65) Prior Publication Data

US 2015/0184652 A1 Jul. 2, 2015

(30) Foreign Application Priority Data

Jul. 30, 2012 (JP) ..... 2012-168677

(51) Int. Cl.
*F01C 21/00* (2006.01)
*F04C 29/00* (2006.01)
(Continued)

(52) U.S. Cl.
CPC ..... *F04C 2/025* (2013.01); *F04C 15/0057* (2013.01); *F04C 29/0085* (2013.01); *F04C 18/0215* (2013.01); *F04C 2240/807* (2013.01)

(58) Field of Classification Search
USPC ..... 418/151, 270, DIG. 1, 55.1–55.5; 417/410.3
See application file for complete search history.

(56) References Cited

FOREIGN PATENT DOCUMENTS

| | | | | |
|---|---|---|---|---|
| JP | 2000-213462 A | | 8/2000 | |
| JP | 2000213462 A | * | 8/2000 | ..... F04B 39/00 |
| JP | 2007-205282 A | | 8/2007 | |

OTHER PUBLICATIONS

International Preliminary Report of corresponding PCT Application No. PCT/JP2013/070573 dated Feb. 12, 2015.
(Continued)

*Primary Examiner* — Deming Wan
(74) *Attorney, Agent, or Firm* — Global IP Counselors, LLP

(57) ABSTRACT

A rotary machine includes a rotor, a rotating shaft fixed to the rotor, and a balance weight fixed to the rotor. The balance weight has a balance part fixed to the rotor and not contacting the shaft, a locking part, a shaft abutting part, and a coupling part coupling the balance part and the shaft-abutting part, The locking part is disposed on a side of the shaft opposite from the balance part. The locking part is locked with the shaft to limit movement of the balance part along a direction of centrifugal force. The shaft-abutting part is positioned between the shaft and the balance part, is coupled with the locking part, and contacts the shaft. A length of the locking part along a rotor radial direction is shorter than a rotor radial distance between the shaft and the balance part. The shaft-abutting part is radially shorter than the locking part.

13 Claims, 6 Drawing Sheets

(51) Int. Cl.

| | |
|---|---|
| ***F04C 15/00*** | (2006.01) |
| ***F01C 1/063*** | (2006.01) |
| ***F04C 2/02*** | (2006.01) |
| *F04C 18/02* | (2006.01) |

(56) References Cited

OTHER PUBLICATIONS

International Search Report of corresponding PCT Application No. PCT/JP2013/070573 dated Oct. 22, 2013.
European Search Report of corresponding EP Application No. 13 82 6002.1 dated Jun. 3, 2015.

* cited by examiner

ROTARY MACHINE AND COMPRESSOR

CROSS-REFERENCE TO RELATED APPLICATIONS

This U.S. National stage application claims priority under 35 U.S.C. §119(a) to Japanese Patent Application No. 2012-168677, filed in Japan on Jul. 30, 2012, the entire contents of which are hereby incorporated herein by reference.

TECHNICAL FIELD

The present invention relates to a rotary machine and a compressor.

BACKGROUND ART

Conventionally, motors comprising a rotor, a rotating shaft coupled with the rotor, and a balance weight fixed to an end surface of the rotor have been used as rotary machines for driving compressors used in air conditioners and other apparatuses. The balance weight reduces unbalanced forces acting on the rotating rotor. When the rotor is rotating in such rotary machines, centrifugal forces acting on the balance weight may cause the rotor to deform. The balance weight disclosed in Japanese Laid-open Patent Application No. 2007-205282 is configured to be capable of locking with the rotating shaft in order to minimize deformation of the rotor.

SUMMARY

Technical Problem

However, the balance weight disclosed in Japanese Laid-open Patent Application No. 2007-205282 is configured from a balance part which maximally contributes to the generation of centrifugal force, a locking part for locking the balance weight with the rotating shaft, and a coupling part for coupling the balance part and the locking part. The locking part and the coupling part bring the center of gravity of the entire balance weight close to the axial center of the rotating shaft. Therefore, the mass of the balance part must be increased in order to generate sufficient centrifugal force to reduce unbalanced forces acting on the rotor. This results in an increase in the mass of the entire balance weight, leading to an increase in the size of the rotary machine that comprises the balance weight. When the mass of the entire balance weight is to be reduced, the mass of the locking part must be minimized; therefore, it may not be possible to ensure the locking part is of adequate strength. As a result, the rotor may deform due to the centrifugal force acting on the balance weight.

An object of the present invention is to provide a rotary machine in which a balance weight can be reduced in weight while ensuring the strength thereof, and a compressor comprising this rotary machine.

Solution To Problem

A rotary machine according to a first aspect of the present invention comprises a rotor, a rotating shaft fixed to the rotor, and a balance weight fixed to the rotor. The balance weight has a balance part, a locking part, a shaft-abutting part, and a coupling part. The balance part is fixed to the rotor and positioned so as not to contact the rotating shaft. The locking part is disposed on a side of the rotating shaft that is opposite from the balance part. The locking part is locked with the rotating shaft so as to limit movement of the balance part along a direction of centrifugal force generated by the rotation of the rotor. The shaft-abutting part is positioned between the rotating shaft and the balance part. The shaft-abutting part is coupled with the locking part. The shaft-abutting part comes into contact with the rotating shaft. The coupling part couples the balance part and the shaft-abutting part. The length of the locking part running along a radial direction of the rotor is shorter than the radial distance of the rotor between the rotating shaft and the balance part. The shaft-abutting part running along the radial direction of the rotor is shorter than the locking part running along the radial direction of the rotor.

The rotary machine according to the first aspect comprises a balance weight for reducing unbalanced forces acting on the rotor with which the rotating shaft is coupled. The balance weight is fixed to an end surface of the rotor, and is subjected to centrifugal force caused by rotation of the rotor. In the balance weight, the balance part which maximally contributes to the generation of centrifugal force and the locking part positioned on a side of the rotating shaft that is opposite from the balance part are coupled by the shaft-abutting part and the coupling part. The locking part locks the balance part, which stretches radially outward as centrifugal force is received, with the rotating shaft coupled with the rotor. The locking part thereby achieves the effect of minimizing deformation of the balance part caused by centrifugal force. In this rotary machine, the balance part and the shaft-abutting part are set apart from each other along the radial direction of the rotor, and are coupled with each other by the coupling part. The coupling part occupies part of a space between the balance part and the shaft-abutting part. The shaft-abutting part along the radial direction is shorter than the locking part along the radial direction. The length of the locking part in the radial direction is set so that deformation of the balance part caused by centrifugal force is sufficiently minimized. Therefore, the size of the shaft-abutting part and the coupling part is reduced while the strength of the locking part is ensured, whereby the mass of the entire balance weight can be minimized. Therefore, in the rotary machine according to the first aspect, the balance weight can be reduced in weight while ensuring the strength thereof.

A rotary machine according to a second aspect of the present invention is the rotary machine according to the first aspect of the present invention, wherein the rotor has a through-hole passing through along the axial direction of the rotating shaft. The coupling part couples the balance part and the shaft-abutting part so as not to overlap with the through-hole as viewed from the axial direction of the rotating shaft.

In the rotary machine according to the second aspect, the rotor has a through-hole. The through-hole is, e.g., a flow channel for refrigerant gas in a rotary machine used in a compressor of a refrigeration apparatus. The through-hole is formed along the rotating shaft, and opens onto the end surface of the rotor. The coupling part of the balance weight is positioned so as not to obstruct the opening of the through-hole.

A rotary machine according to a third aspect of the present invention is the rotary machine according to the first aspect of the present invention, wherein the balance part is fixed to the rotor by a fixing member. The coupling part couples the balance part and the shaft-abutting part so that a virtual extension extending from the shaft-abutting part toward the balance part does not overlap with the fixing member as viewed from the axial direction of the rotating shaft.

In the rotary machine according to the third aspect, the balance part is fixed to the end surface of the rotor by a bolt or other fixing member. The fixing member minimizes deformation of the balance part caused by centrifugal force. The coupling part of the balance weight is coupled with the balance part at a location that readily deforms due to centrifugal force, as with a portion between adjacent fixing members. This makes it possible to effectively suppress deformation of the balance weight caused by centrifugal force.

A rotary machine according to a fourth aspect of the present invention is the rotary machine according to any of the first through third aspects of the present invention, wherein the thickness of at least a part of the shaft-abutting part is zero.

In the rotary machine according to the fourth aspect, the shaft-abutting part is configured such as to be partially incomplete along a circumferential direction of the rotary shaft. This reduces the weight of the shaft-abutting part, making it possible to effectively minimize the mass of the balance weight.

A rotary machine according to a fifth aspect of the present invention is the rotary machine according to any of the first through fourth aspects of the present invention, wherein the balance weight is shaped such that there is substantially no distance between the center of gravity of a portion comprising the locking part, the shaft-abutting part, and the coupling part and the axial center of the rotating shaft.

In the rotary machine according to the fifth aspect, the balance weight is shaped such that the center of gravity of a portion excluding the balance part is as close as possible to the axial center of the rotating shaft. This makes it possible to minimize to mass of the balance part, which maximally contributes to the centrifugal force acting on the balance weight, and effectively minimizes the mass of the balance weight.

A rotary machine according to a sixth aspect of the present invention is the rotary machine according to any of the first through fifth aspects of the present invention, wherein the balance part is thicker than the locking part, the shaft-abutting part, and the coupling part.

In the rotary machine according to the sixth aspect, the portion excluding the balance part is made thinner than the balance part, whereby the mass of the portion excluding the balance part is minimized. This makes it possible to effectively minimize the mass of the balance weight.

A compressor according to a seventh aspect of the present invention comprises the rotary machine according to any of the first through sixth aspects of the present invention.

ADVANTAGEOUS EFFECTS OF INVENTION

In the rotary machine according to the first through sixth aspects of the present invention, the balance weight can be reduced in weight while ensuring the strength thereof.

In the rotary machine according to the third aspect of the present invention, deformation of the balance weight caused by centrifugal force can be effectively suppressed.

In the rotary machine according to the fourth through sixth aspects of the present invention, the mass of the balance weight can be effectively minimized.

The compressor according to the seventh aspect of the present invention can be reduced in weight.

DESCRIPTION OF EMBODIMENTS

<First Embodiment>

A compressor according to a first embodiment of the present invention will be described with reference to the annexed drawings. The compressor according to the present embodiment is a high-low pressure domed scroll compressor. A scroll compressor changes the volume of a space formed by two scroll members that mesh with each other, whereby the compressor compresses a refrigerant circulating in a refrigeration apparatus.

(1) Configuration of Compressor

Figure 1:
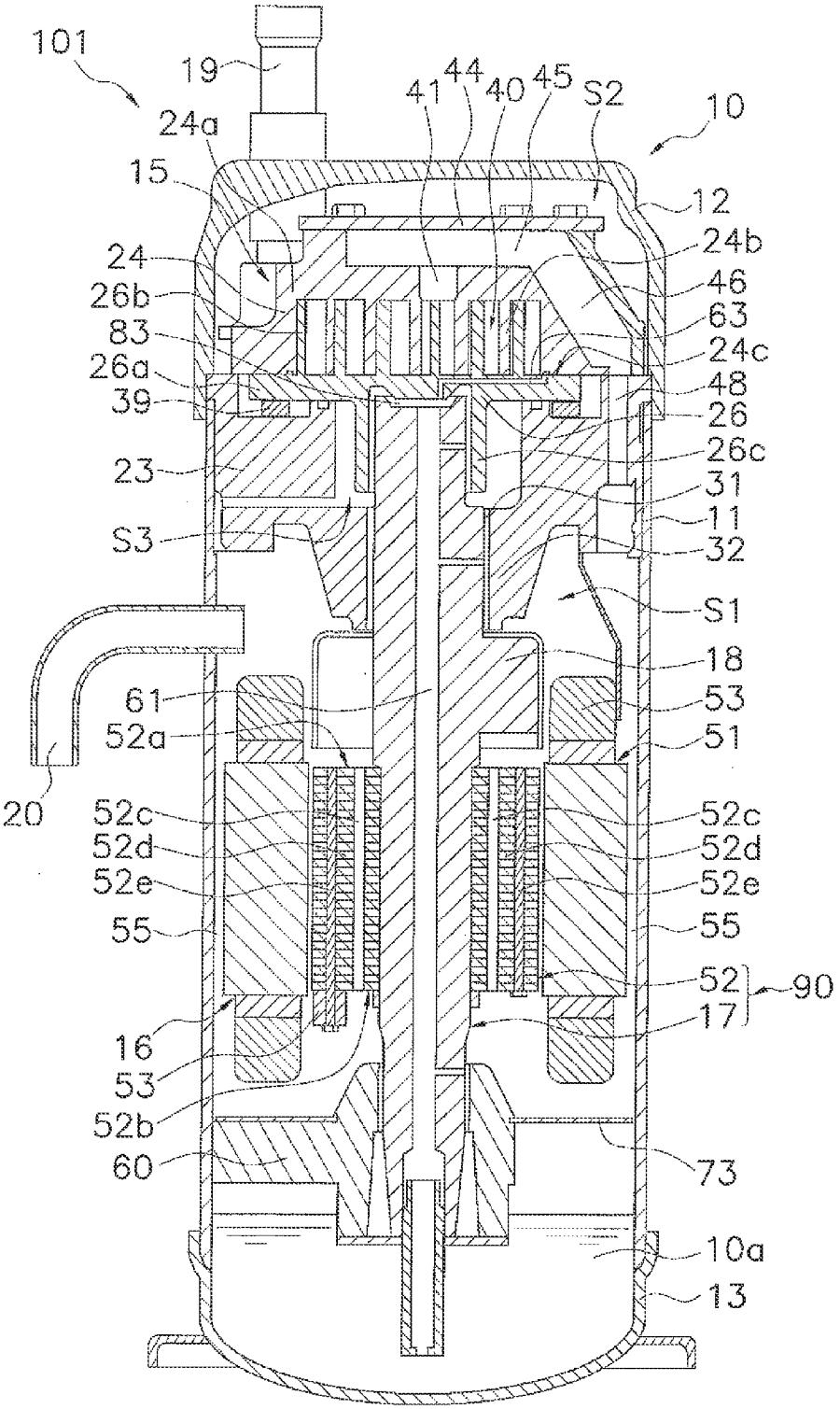
FIG. 1 is a vertical cross-sectional view of a scroll compressor according to a first embodiment of the present invention.

FIG. 1 is a vertical cross-sectional view of a scroll compressor 101 according to the present embodiment. The scroll compressor 101 is primarily configured from a casing 10, a compression mechanism 15, a housing 23, a drive motor 16, a crankshaft 17, a lower bearing 60, an intake pipe 19, and a discharge pipe 20.

(1-1) Casing

The casing 10 is configured from a substantially cylindrical barrel casing part 11, a bowl-shaped upper wall part 12 hermetically welded to an upper end part of the barrel casing part 11, and a bowl-shaped bottom wall part 13 hermetically welded to a lower end part of the barrel casing part 11. The casing 10 is disposed such that an axial direction of the substantially cylindrical shape of the barrel casing part 11 runs vertically.

Within the casing 10 is accommodated the compression mechanism 15, the housing 23 disposed below the compression mechanism 15, the drive motor 16 disposed below the housing 23, the crankshaft 17 disposed so as to extend vertically, and other such parts. The intake pipe 19 and the discharge pipe 20 are hermetically welded to a wall part of the casing 10. An oil reservoir space 10*a* in which a lubricant accumulates is formed in the bottom part of the casing 10. The lubricant is used during movement of the scroll compressor 101 in order to maintain proper lubrication of sliding parts in the compression mechanism 15.

(1-2) Compression Mechanism

The compression mechanism 15 draws in low-temperature, low-pressure refrigerant gas, compresses the gas, and then discharges high-temperature, high-pressure refrigerant gas (referred to as "compressed refrigerant" below). The compression mechanism 15 is primarily configured from a fixed scroll component 24 and a movable scroll component 26.

The fixed scroll 24 has a first mirror plate 24*a*, and an involutely shaped first lap 24*b* formed upright on the first mirror plate 24*a*. Within the fixed scroll 24 is formed a main intake hole (not shown), and an auxiliary intake hole (not shown) adjacent to the main intake hole. The main intake hole interconnects the intake pipe 19 and a compression chamber 40 described below. The auxiliary intake hole interconnects a low-pressure space S2 (described below) and the compression chamber 40. A discharge hole 41 is formed in a central part of the first mirror plate 24*a*. The discharge hole 41 interconnects a recessed space in an upper surface of the first mirror plate 24*a* with a muffler space 45 covered by a lid body 44. The muffler space 45 communicates with a first compressed refrigerant flow channel 46 which opens onto an outer peripheral part of a lower surface of the fixed scroll 24.

The movable scroll 26 has a second mirror plate 26*a*, and an involutely shaped second lap 26*b* formed upright on the second mirror plate 26*a*. An upper end bearing 26*c* is formed in a central part of a lower surface of the second mirror plate 26*a*. An oil supply hole 63 is formed in the second mirror plate 26*a*. The oil supply hole 63 interconnects an outer peripheral part of an upper surface of the second mirror plate 26*a* and a space inside the upper end bearing 26*c*.

The first lap 24*b* and the second lap 26*b* of the fixed scroll 24 and the movable scroll 26 mesh respectively with each other, whereby the compression chamber 40 configured in a space enclosed by the first mirror plate 24*a*, the first lap 24*b*, the second mirror plate 26*a*, and the second lap 26*b* is formed. The volume of the compression chamber 40 varies due to the revolving motion of the movable scroll 26.

(1-3) Housing

An outer side surface of the housing 23 is hermetically joined to an inner surface of the casing 10, thereby partitioning a space inside the casing 10 into a high-pressure space S1 below the housing 23 and a low-pressure space S2 above the housing 23. The fixed scroll 24 is mounted on the housing 23, and the housing 23 and fixed scroll 24 are disposed on either side of the movable scroll 26 with an Oldham's coupling 39 interposed therebetween. The Oldham's coupling 39 is an annular member for preventing the movable scroll 26 from rotating in association. A second compressed refrigerant flow channel 48 is formed vertically through an outer peripheral part of the housing 23. The second compressed refrigerant flow channel 48 communicates with the first compressed refrigerant flow channel 46 in the upper surface of the housing 23, and with the high-pressure space S1 in the lower surface of the housing 23.

A crank chamber S3 is recessed in a center part of the upper surface of the housing 23. A housing through-hole 31 is also formed in the housing 23. The housing through-hole 31 passes vertically through the housing 23 from a center part of the bottom surface of the crank chamber S3 to a center part of the lower surface of the housing 23. The portion of the housing 23 in which the housing through-hole 31 is formed is referred to below as an upper bearing 32.

(1-4) Drive Motor

The drive motor 16 is a brushless DC motor disposed below the housing 23. The drive motor 16 is primarily configured from a stator 51 fixed to the inner surface of the casing 10, and a rotor 52 accommodated inside the stator 51, an air gap being provided therein to allow rotation.

The stator 51 has a coil part (not shown) formed from a wound conductive wire, and a coil end 53 formed above and below the coil part. A plurality of notched core cut parts (not shown) are provided in an outside surface of the stator from the upper end surface thereof to the lower end surface thereof and at prescribed intervals along the circumferential direction. The core cut parts form a motor cooling passage 55 extending vertically between the barrel casing part 11 and the stator 51.

The rotor 52 is configured from a plurality of metal plates 52*d* layered vertically. The plurality of metal plates 52*d* are jointly fastened by rivets 52*e* and are integrally formed. The rotor 52 has a through-hole 52*c* passing vertically therethrough from the upper end surface 52*a* to the lower end surface 52*b*. The rotor 52 is interconnected with the crankshaft 17, which passes vertically through the rotational center of the rotor 52. The rotor 52 is connected with the compression mechanism 15, with the crankshaft 17 interposed therebetween. A balance weight 53 is also attached to the lower end surface 52*b* of the rotor 52. The configuration of the balance weight 53 will be described in detail hereafter.

(1-5) Crankshaft

The crankshaft 17 is disposed so that the axial direction thereof runs vertically. The crankshaft 17 is shaped such that the axial center of an upper end part thereof is slightly eccentric in relation to the axial center of a portion excluding the upper end part. The crankshaft 17 has an eccentric weight 18. The eccentric weight 18 is securely attached to the crankshaft 17 at a position below the housing 23 and above the drive motor 16.

The crankshaft 17 is also interconnected with the rotor 52 vertically through the rotational center of the rotor 52. The upper end part of the crankshaft 17 is inserted into the upper end bearing 26*c* of the movable scroll 26. The crankshaft 17 is supported by the upper part bearing 32 and the lower bearing 60.

The crankshaft 17 also has therein a primary oil supply channel 61 funned so as to run along the axial direction of the crankshaft 17. The upper end of the primary oil supply channel 61 communicates with an oil chamber 83 funned by the upper end surface of the crankshaft 17 and the lower surface of the second mirror plate 26*a*. The oil chamber 83 communicates with a thrust bearing surface 24*c*, which is a surface on which the first mirror plate 24*a* and the second mirror plate 26*a* make sliding contact with each other on an outer peripheral portion, with the oil supply hole 63 of the second mirror plate 26*a* interposed therebetween. The lower end of the primary oil supply channel 61 communicates with the oil reservoir space 10*a* in the bottom part of the casing 10.

(1-6) Lower Bearing

The lower bearing 60 is disposed below the drive motor 16. An outside surface of the lower bearing 60 is hermetically joined to part of the inner surface of the casing 10. The lower bearing 60 rotatably supports the crankshaft 17. An oil separating plate 73 is attached to an upper surface of the lower bearing.

(1-7) Intake Pipe

The intake pipe 19 is a pipe for guiding refrigerant from outside the casing 10 to the compression mechanism 15. The intake pipe 19 is hermetically joined to the upper wall part 12 of the casing 10. The intake pipe 19 passes vertically through the low-pressure space S2. An end part of the intake pipe 19 that is inside the casing 10 is inserted into the fixed scroll 24.

(1-8) Discharge Pipe

The discharge pipe 20 is a pipe for discharging compressed refrigerant from the high-pressure space S1 out of the casing 10. The discharge pipe 20 is hermetically joined to the barrel casing part 11 of the casing 10. An end part of the discharge pipe 20 that is inside the casing 10 is positioned in the high-pressure space S1 at a position below the housing 23 and above the drive motor 16.

(2) Operation of Compressor

First, the flow of the refrigerant inside the scroll compressor 101 will be described. Then, the flow of lubricating oil inside the scroll compressor 101 will be described.

(2-1) Flow of Refrigerant

First, the rotor 52 begins to rotate due to the start-up of the drive motor 16, and the crankshaft 17 fixed to the rotor 52 begins an axial rotational movement. The axial rotation of the crankshaft 17 is transmitted to the movable scroll 26 of the compression mechanism 15 via the upper surface bearing 26*c*. The movable scroll 26 revolves around the fixed scroll 24, but, due to the Oldham's coupling 39, does not rotate.

Uncompressed, low-temperature, low-pressure refrigerant is drawn into the compression chamber 40 of the compression mechanism 15 either from the intake pipe 19 via a primary intake hole or from the low-pressure space S2 via an auxiliary intake hole. Due to the revolution of the movable scroll 26, the compression chamber 40 moves from the outer peripheral part of the fixed scroll 24 toward the center part thereof while the volume of the compression chamber 40 is gradually reduced. As a result, the refrigerant in the compression chamber 40 is compressed and becomes compressed refrigerant. The compressed refrigerant is discharged from the discharge hole 41 to the muffler space 45, and is supplied to the high-pressure space S1 via the first compressed refrigerant flow channel 46 and the second compressed refrigerant flow channel 48. The compressed refrigerant then flows down the motor cooling passage 55 and reaches the high-pressure space S1 below the drive motor 16. The direction of flow of the compressed refrigerant is then reversed, and the compressed refrigerant travels upward through the other motor cooling passage 55, the through-hole 52*c* of the rotor 52, and the air gap of the drive motor 16. The compressed refrigerant is then discharged from the discharge pipe 20 out of the scroll compressor 101.

(2-2) Flow of Lubricating Oil

When the compression mechanism 15 is started up by the axial rotational movement of the crankshaft 17 and the compressed refrigerant is initially supplied to the high-pressure space S1, the pressure in the high-pressure space S1, which includes the oil reservoir space 10*a*, rises. The pressure in the compression chamber 40 of the compression mechanism 15 is brought below the pressure in the high-pressure space S1, the compression chamber 40 being communicated with the oil chamber 83 with the thrust bearing surface 24*c* and the oil supply hole 63 interposed therebetween. Therefore, a pressure differential occurs in the oil reservoir space 10*a* and the primary oil supply channel 61 of the crankshaft 17 communicated with the oil chamber 83. The lubricating oil in the high-pressure-side oil reservoir space 10*a* thereby travels upward through the primary oil supply channel 61 toward the low-pressure-side oil chamber 83.

Some of the lubricating oil traveling upward through the primary oil supply channel 61 is supplied, via a secondary oil supply channel horizontally diverging from the primary oil supply channel 61 to each of a sliding-contact surface between the crankshaft 17 and the lower bearing 60, a sliding-contact surface between the crankshaft 17 and the upper bearing 32 of the housing 23, and a sliding-contact surface between the crankshaft 17 and the upper end bearing 26*c* of the movable scroll 26, and is returned to the oil reservoir space 10*a*. Lubricating oil that has traveled upward through the primary oil supply channel 61 and reached the oil chamber 83 is supplied to the thrust bearing surface 24*c* of the compression mechanism 15 via the oil supply hole 63, and flows into the compression chamber 40. At this time, the high-temperature lubricating oil heats the uncompressed, low-temperature refrigerant present in the compression chamber 40, and is mixed into the refrigerant as minute droplets. The lubricating oil mixed into the compressed refrigerant in the compression chamber 40 is supplied to the high-pressure space S1 through the same passage as is the compressed refrigerant. The lubricating oil then flows down the motor cooling passage 55 together with the compressed refrigerant and strikes the oil separating plate 73. The lubricating oil that adheres to the oil separating plate 73 travels downward toward the oil reservoir space 10*a*.

(3) Configuration of Balance Weight

Figure 2:
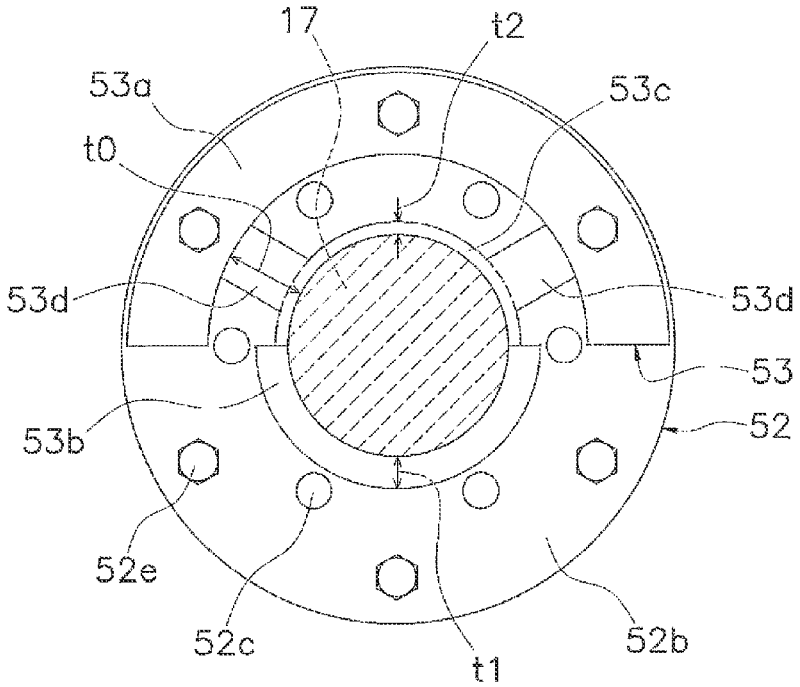
FIG. 2 is a bottom view of a rotor.
Figure 3:
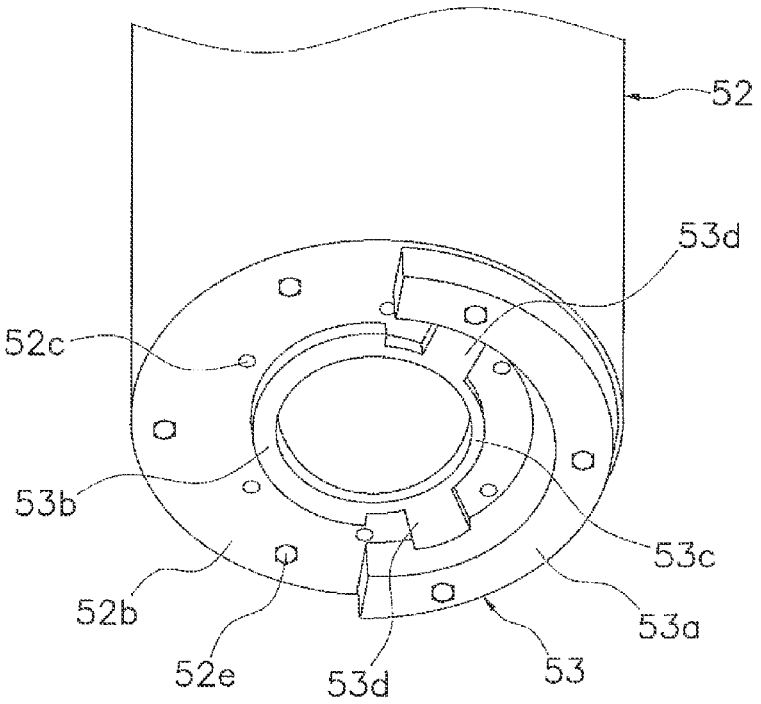
FIG. 3 is a perspective view of a balance weight attached to the rotor.

The configuration of the balance weight 53 will now be described in detail. FIG, 2 is a bottom view of the lower end surface 52*b* of the rotor 52 as viewed from below along the vertical direction. For descriptive purposes, FIG. 2 shows a horizontal cross-section of the crankshaft 17 at the height position of the lower end surface 52*b* of the rotor 52. FIG. 3 is a perspective view of the balance weight 53 attached to the lower end surface 52*b* of the rotor 52. In FIG. 3, the crankshaft 17 is not redundantly shown. In the present embodiment, the rotor 52 has six rivets 52*e* and six through-holes 52*c*. The six rivets 52*e* are disposed at positions in the outer peripheral part of the rotor 52 that have six-fold symmetry about the axial center of the crankshaft 17. The six through-holes 52*c* are disposed in portions outward along the radial direction from the crankshaft 17 and inward along the radial direction from the balance weight 53, the through-holes being positioned so as to have six-fold symmetry about the axial center of the crankshaft 17. Here, "radial direction" refers to the radial direction of the rotor 52. When the rotor 52 is viewed along the crankshaft 17, "outward along the radial direction" refers to the outer-peripheral side of the end surface of the rotor 52, and "inward along the radial direction" refers to the central side of the end surface of the rotor 52.

Below, a member configured from the crankshaft 17 and the rotor 52 is referred to as a rotating body 90. The balance weight 53 of the rotor 52 and the eccentric weight 18 of the crankshaft 17 are weights for counteracting unbalanced forces generated by the rotation of the rotating body 90. The balance weight 53 is configured from a balance part 53*a*, a locking part 53*b*, a shaft-abutting part 53*c*, and two coupling parts 53*d*.

(3-1) Balance Part

As shown in FIG. 2, the balance part 53*a* is C-shaped and is directly fixed by three rivets 52*e* to the lower end surface 52*b* of the rotor 52 at positions where no contact is made with the crankshaft 17. Specifically, from among the six rivets 52*e* integrating the metal plates 52*d* constituting the rotor 52, three rivets 52*e* jointly fasten the metal plates 52*d* and the balance part 53*a*.

In the present embodiment, the balance weight 53 is configured such that the center of gravity of a portion comprising the locking part 53*b*, the shaft-abutting part 53*c*, and the coupling parts 53*d* is as close as possible to the axial center of the rotating shaft 17. Accordingly, the contribution made by the centrifugal force acting on the balance weight 53 due to the rotation of the rotating body 90 is greatest where the centrifugal force acts on the balance part 53*a*.

(3-2) Locking Part

When the balance weight 53 is viewed along the crankshaft 17, the locking part 53*b* is positioned on a side of the crankshaft 17 opposite the balance part 53*a*. The locking part 53*b* locks the balance weight 53 with the rotating shaft 17 so as to prevent the balance part 53*a* from moving radially outward due to centrifugal force caused by the rotation of the rotating body 90. The locking part 53*b* is C-shaped, as shown in FIG. 2. The side surface of the locking part 53*b* on the inward side in the radial direction is in contact with the outer peripheral surface of the crankshaft 17. The length t1 of the locking part 53*b* running along the radial direction is shorter than the radial distance t0 between the rotating shaft 17 and the balance part 53*a*. Specifically, the locking part 53*b* is sized to prevent the locking part 53*b* making contact with the balance part 53*a*. The locking part 53*b* is thinner than the balance part 53*a*.

(3-3) Shaft-Abutting Part

When the balance weight 53 is viewed along the crankshaft 17, the shaft-abutting part 53*c* is positioned between the crankshaft 17 and the balance part 53*a*. The shaft-abutting part 53*c* is coupled with the locking part 53*b*. The side surface of the shaft-abutting part 53*c* on the inward side in the radial direction is in contact with the outer peripheral surface of the crankshaft 17. As shown in FIG. 2, the length t2 of the shaft-abutting part 53*c* running along the radial direction is shorter than the length t1 of the locking part 53*b* running along the radial direction. The shaft-abutting part 53*c* is of the same thickness as the locking part 53*b*, and is thinner than the balance part 53*a*.

(3-4) Coupling Parts

The two coupling parts 53*d* couple the balance part 53*a* and the shaft-abutting part 53*c* approximately along the radial direction, When the balance weight 53 is viewed along the crankshaft 17, the coupling parts 53*d* couple the balance part 53*a* and the shaft-abutting part 53*c* on a portion between two through-holes 52*c* that are adjacent to each other. Specifically, the coupling parts 53*d* are positioned so as not to obstruct the through-holes 52*c* opening in the lower end surface 52*b* of the rotor 52

In the present embodiment, as shown in FIG. 2, two of the six through-holes 52*c* are positioned radially outward from each of the boundaries of the locking part 53*b* and the shaft-abutting part 53*c*. Each of the six rivets 52*e* is positioned radially outward from the midpoints of two through-holes 52*c* that are adjacent to each other. The two coupling parts 53*d* couple the balance part 53*a* and the shaft-abutting part 53*c* between a through-hole 52*c* positioned radially outward from the boundaries of the locking part 53*b* and the shaft-abutting part 53*c* and a through-hole 52*c* adjacent to the first through-hole 52*c* on the balance part 53*a*-side thereof. The coupling parts 53*d* are of the same thickness as the locking part 53*b* and the shaft-abutting part 53*c*, and are thinner than the balance part 53*a*.

(4) Features of Compressor (4-1)

In the present embodiment, the drive motor 16 comprises a balance weight 53 for reducing unbalanced forces caused by rotation of the rotating body 90. The centrifugal force acting on the balance weight 53 due to rotation of the rotor 52, together with the centrifugal force acting on the eccentric weight 18 of the crankshaft 17, act as unbalanced forces counteracting the unbalanced forces of the rotating body 90. Any unbalanced force remaining in the rotating body 90 during rotation will cause the rotating body 90 to vibrate when rotating, thus producing noise in the drive motor 16. Specifically, the unbalanced forces in the rotating body 90 are reduced by the balance weight 53 and the eccentric weight 18, and noise in the drive motor 16 is minimized.

In the present embodiment, when the balance weight 53 is viewed along the crankshaft 17, the shaft-abutting part 53*c* and the coupling parts 53*d* coupling the balance part 53*a* and the locking part 53*b* occupy part of a portion between the balance part 53*a* and the crankshaft 17, as shown in FIG. 2. The locking part 53*b*, the shaft-abutting part 53*c*, and the coupling parts 53*d* are thinner than the balance part 53*a*. Therefore, the balance part 53*a* is shaped such that the mass of a portion excluding the balance part 53*a* is minimized. Because the mass of the entire balance weight 53 is thereby minimized, the drive motor 16 can be reduced in weight. Therefore, the scroll compressor 101 can be reduced in weight.

(4-2)

In the present embodiment, there is substantially no distance between the center of gravity of a portion comprising the locking part 53*b*, the shaft-abutting part 53*c*, and the coupling parts 53*d* and the axial center of the crankshaft 17. Therefore, the centrifugal force acting on the balance part 53*a* is not reduced by the centrifugal force acting on the portion excluding the balance part 53*a* to the same extent as when the center of gravity of the portion excluding the balance part 53*a* is positioned opposite the balance part 53*a* across the axial center of the crankshaft 17. Therefore, the mass of the balance part 53*a*, which maximally contributes to the centrifugal force acting on the balance weight 53, can be minimized. Because the mass of the entire balance weight 53 is thereby minimized, the drive motor 16 can be reduced in weight. Additionally, because the size of the balance weight 53 is minimized, the drive motor 16 can be made compact.

(4-3)

In the present embodiment, as shown in FIG. 2, the length t2 of the shaft-abutting part 53*c* running along the radial direction is shorter than the length t1 of the locking part 53*b* running along the radial direction. Therefore, the locking part 53*b* can be given the minimum strength necessary for locking the balance weight 53, and the shaft-abutting part 53*c* can be given the minimum strength necessary for molding and machining. Because the mass of the entire balance weight 53 is thereby minimized, the drive motor 16 can be reduced in weight.

(4-4)

In the present embodiment, the coupling parts 53*d* of the balance weight 53 couple the balance part 53*a* and the shaft-abutting part 53*c* so as not to obstruct the through-holes 52*c* opening onto the lower end surface 52*b* of the rotor 52. This makes it possible for the compressed refrigerant in the high-pressure space S1 to travel upward and pass through the through-holes 52*c* in the rotor 52 after flowing down the motor cooling passage 55 without being inhibited by the coupling parts 53*d*. Therefore, the rotor 52 is effectively cooled by the compressed refrigerant passing through the through-holes 52*c*. Additionally, because the cross-sectional area of the flow channel of the compressed refrigerant is ensured by the through-holes 52*c*, the flow velocity of the compressed refrigerant traveling upward through the high-pressure space S1 inside the casing 10 can be suppressed. Therefore, the lubricating oil mixed into the compressed refrigerant can be prevented from being discharged together with the compressed refrigerant out of the scroll compressor 101 via the discharge pipe 20. Because oil loss is reduced, the reliability of he scroll compressor 101 is thereby enhanced.

<Second Embodiment>

A scroll compressor according to a second embodiment of the present invention will now be described. Because the basic configuration, operation, and features of the present embodiment are the same as those of the scroll compressor according to the first embodiment, the points of difference from the first embodiment will mainly be described. Elements having the same structure and function as in the first embodiment are given the same symbols.

(1) Configuration of Balance Weight

Figure 4:
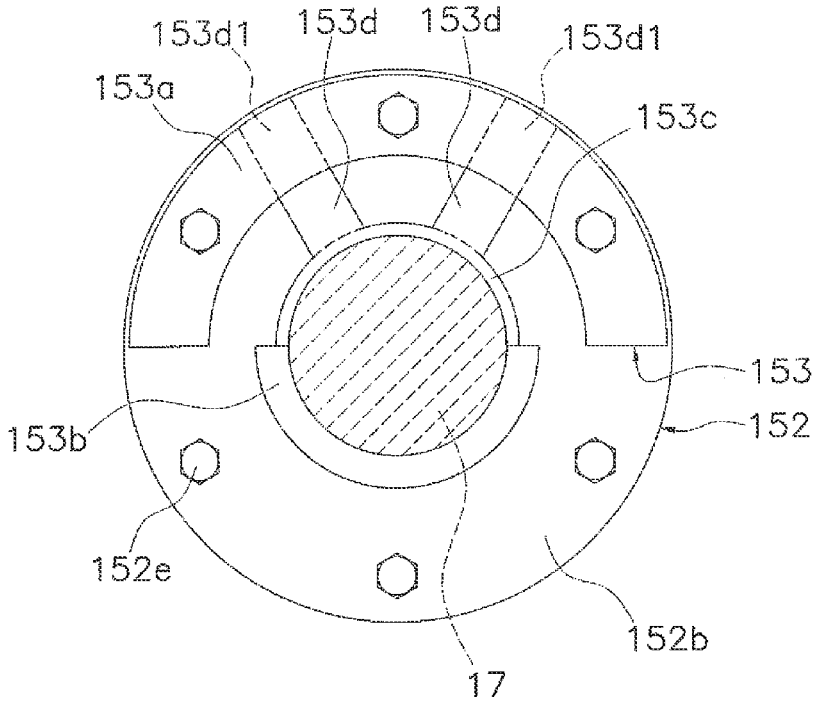
FIG. 4 is a bottom view of a rotor according to a second embodiment of the present invention.

FIG. 4 is a bottom view of a rotor 152 to which a balance weight 153 of the present embodiment is attached. The balance weight 153 is attached to a lower end surface 152*b* of the rotor 152. The balance weight 153 is configured from a balance part 153*a*, a locking part 153*b*, a shaft-abutting part 153*c*, and two coupling parts 153*d*. The rotor 152 has six rivets 152*e*, similarly to the first embodiment. The rotor 152 does not have through-holes corresponding to the through-holes 52*c* of the rotor 52 in the first embodiment.

In the present embodiment, when the balance weight 153 is viewed along a crankshaft 17, the two coupling parts 153*d* couple the balance part 153*a* and the shaft-abutting part 153*c* so that a virtual extension 153*d*1 extending the coupling parts 153*d* from the shaft-abutting part 153*c* toward the balance part 153*a* does not overlap with the rivets 152*e*.

(2) Features of Compressor

In the present embodiment, the coupling parts 153*d* are coupled with the balance part 153*a* on a portion between two rivets 152*e* that are adjacent to each other. The portion between two rivets 152*e* that are adjacent to each other is a location at which the balance part 153*a* readily deforms due to centrifugal force caused by the rotation of a rotating body 90. Therefore, the coupling parts 153*d* couple with a portion at which the balance part 153*a* readily deforms, whereby the strength of the balance part 153*a* can be increased and deformation of the balance weight 153 caused by centrifugal force can be effectively suppressed.

<Third Embodiment>

A scroll compressor according to a third embodiment of the present invention will now be described. Because the basic configuration, operation, and features of the present embodiment are the same as those of the scroll compressor according to the first embodiment, the points of difference from the first embodiment will mainly be described. Elements having the same structure and function as in the first embodiment are given the same symbols.

(1) Configuration of Balance Weight

Figure 5:
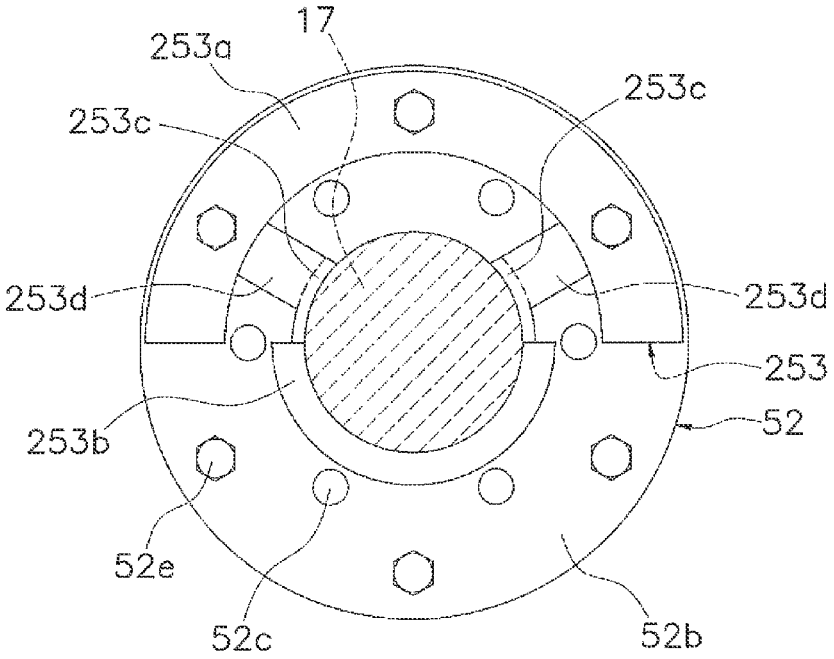
FIG. 5 is a bottom view of a rotor according to a third embodiment of the present invention.

FIG. 5 is a bottom view of a rotor 52 to a balance weight 253 of the present embodiment is attached. The balance weight 253 is configured from a balance part 253*a*, a locking part 253*b*, a shaft-abutting part 253*c*, and two coupling parts 253*d*. The shaft-abutting part 253*c* has a portion having a thickness of zero. Specifically, the shaft-abutting part 253*c* differs from the shaft-abutting part 53*c* of the first embodiment in being configured such that the shaft-abutting part 253*c* is partially incomplete along a circumferential direction of the crankshaft 17. Therefore, as shown in FIG. 5, the shaft-abutting part 253*c* is configured from two portions coupled with two circumferential end parts of the locking part 253*b*, respectively.

(2) Features of Compressor

In the present embodiment, because the shaft-abutting part 253*c* is configured such as to be partially incomplete along the circumferential direction of the crankshaft 17, the shaft-abutting part 253*c* weighs less than the shaft-abutting parts of the first and second embodiments. Therefore, the mass of the balance weight 253 can be effectively minimized.

<Modifications>

The basic configuration of the first through third embodiments of the present invention can be modified without departing from the main point of the present invention. Modifications applicable to the embodiments of the present invention are described below.

(1) Modification A

Figure 6:
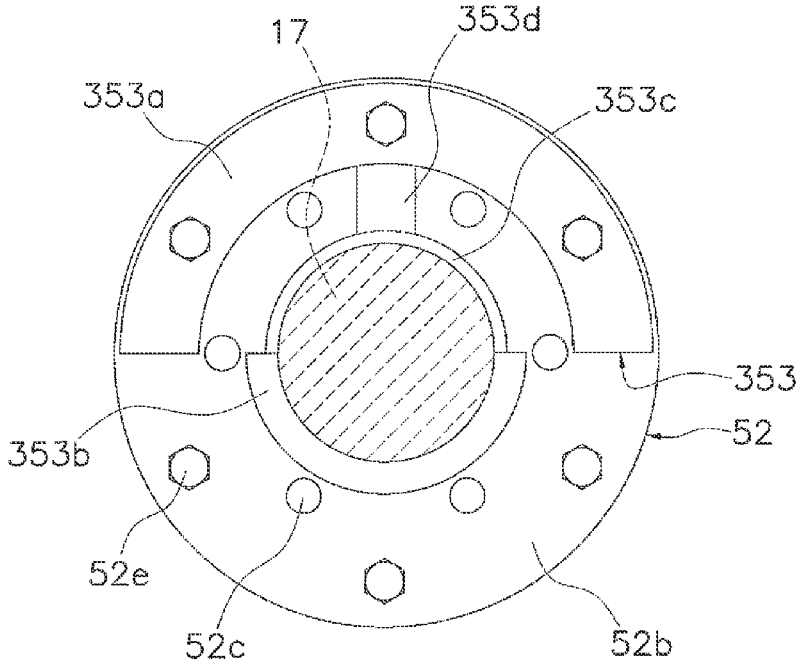
FIG. 6 is a bottom view of a rotor according to Modification A.

FIG. 6 is a bottom view of a rotor 52 to which a balance weight 353 according to a first modification of the balance weight 53 of the first embodiment is attached. The balance weight 353 is configured from a balance part 353*a*, a locking part 353*b*, a shaft-abutting part 353*c*, and one coupling part 353*d*.

In the present modification, the number and position of the coupling part 353*d* of the balance weight 353 differ from those of the coupling parts 53*d* of the balance weight 53 of the first embodiment. As shown in FIG. 6, the one coupling part 353*d* couples a circumferential center part of the balance part 353*a* and a circumferential center part of the shaft-abutting part 353*c* between two through-holes 52*c* that are adjacent to each other.

(2) Modification B

Figure 7:
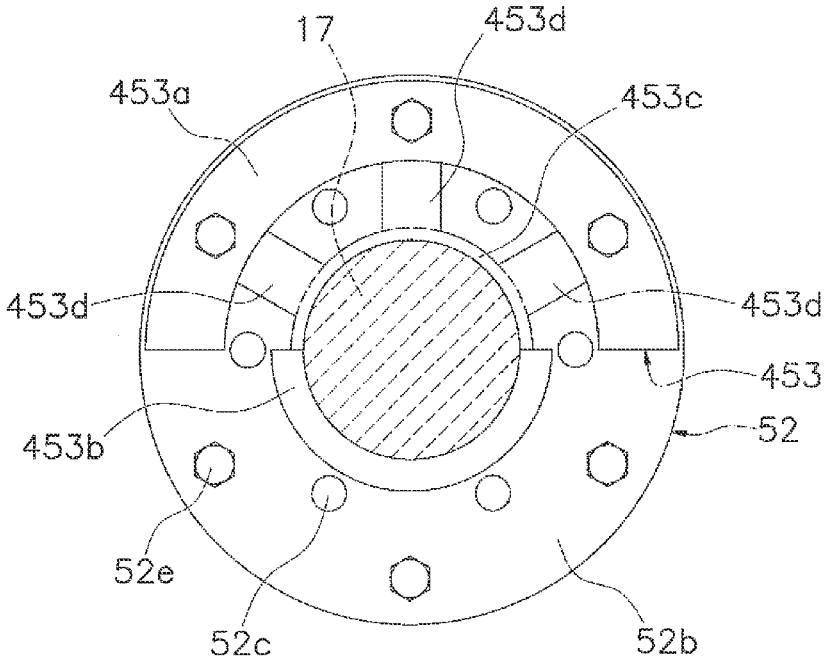
FIG. 7 is a bottom view of a rotor according to Modification B.

FIG. 7 is a bottom view of a rotor 52 to which a balance weight 453 according to a second modification of the balance weight 53 of the first embodiment is attached. The balance weight 453 is configured from a balance part 453*a*, a locking part 453*b*, a shaft-abutting part 453*c*, and three coupling parts 453*d*.

In the present modification, the number and position of the coupling parts 453*d* of the balance weight 453 differ from those of the coupling parts 53*d* of the balance weight 53 of the first embodiment. As shown in FIG. 7, the three coupling parts 453*d* couple the balance part 453*a* and the shaft-abutting part 453*c* from between two through-holes 52*c* that are adjacent to each other. Specifically, the balance weight 453 has the two coupling parts 53*d* of the balance weight 53 of the first embodiment, and the one coupling part 353*d* of the balance weight 353 of modification A.

(3) Modification C

Figure 8:
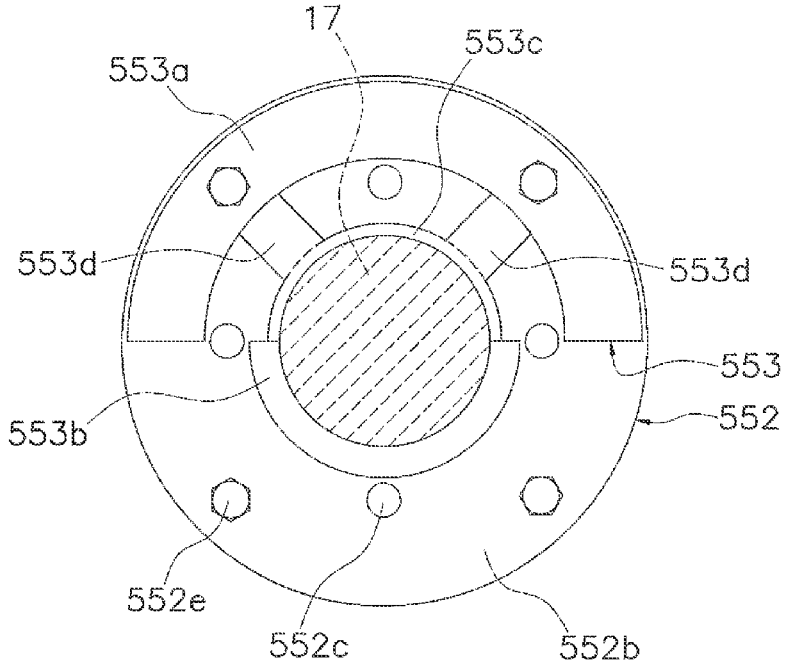
FIG. 8 is a bottom view of a rotor according to Modification C.

FIG. 8 is a bottom view of a rotor 552 to which a balance weight 553 according to a third modification of the balance weight 53 of the first embodiment is attached. The balance weight 553 is attached to a lower end surface 552*b* of the rotor 552. The balance weight 553 is configured from a balance part 553*a*, a locking part 553*b*, a shaft-abutting part 553*c*, and two coupling parts 553*d*. The rotor 552 has four rivets 552*e* and four through-holes 552*c*. The four rivets 552*e* and the four through-holes 552*c* are disposed at positions so as to have four-fold symmetry about the axial center of the crankshaft 17.

In the present modification, as shown in FIG. 8, two of the four through-holes 552*c* are positioned radially outward from each of the boundaries of the locking part 553*b* and the shaft-abutting part 553*c*. Each of the four rivets 552*e* is positioned radially outward from the midpoints of two through-holes 552*c* that are adjacent to each other. The two coupling parts 553*d* couple the balance part 553*a* and the shaft-abutting part 553*c* between a through-hole 552*c* positioned radially outward from the boundaries of the locking part 553*b* and the shaft-abutting part 553*c* and a through-hole 552*c* adjacent to the first through-hole 552*c* on the balance part 553*a*-side thereof.

(4) Modification D

Figure 9:
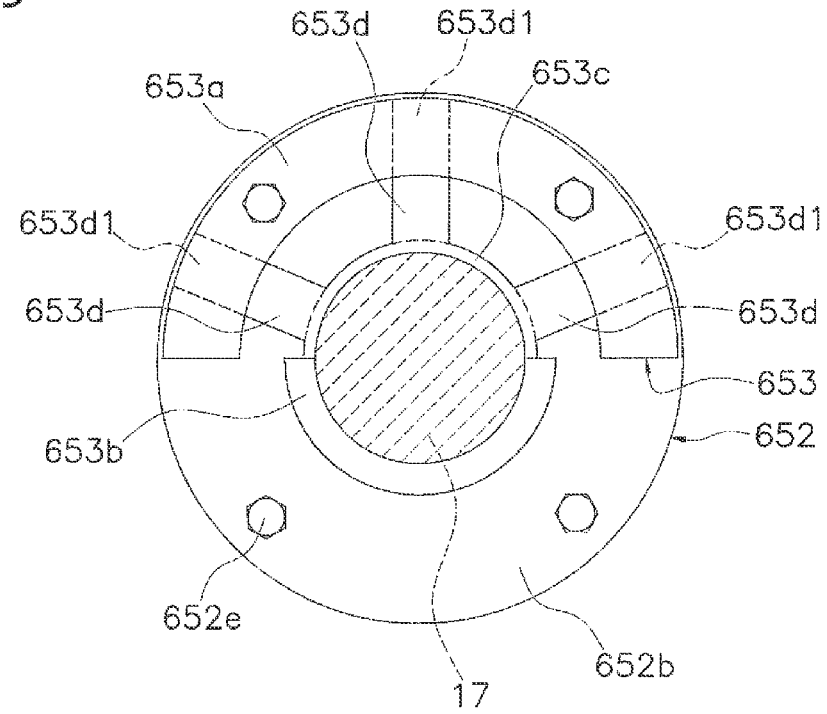
FIG. 9 is a bottom view of a rotor according to Modification D.

FIG. 9 is a bottom view of a rotor 652 to which a balance weight 653 according to a first modification of the balance weight 153 of the second embodiment is attached. The balance weight 653 is attached to a lower end surface 652*b* of the rotor 652. The balance weight 653 is configured from a balance part 653*a*, a locking part 653*b*, a shaft-abutting part 653*c*, and three coupling parts 653*d*. The rotor 652 has four rivets 652*e*. The four rivets 652*e* are disposed in the same positions as are the four rivets 552*e* of modification C.

In the present modification, as shown in FIG. 9, when the balance weight 653 is viewed along the crankshaft 17, the three coupling parts 653*d* couple the balance part 653*a* and the shaft-abutting part 653*c* so that a virtual extension 653*d*1 extending the coupling parts 653*d* from the shaft-abutting part 653*c* toward the balance part 653*a* does not overlap with the rivets 652*e*.

(5) Modification E

Figure 10:
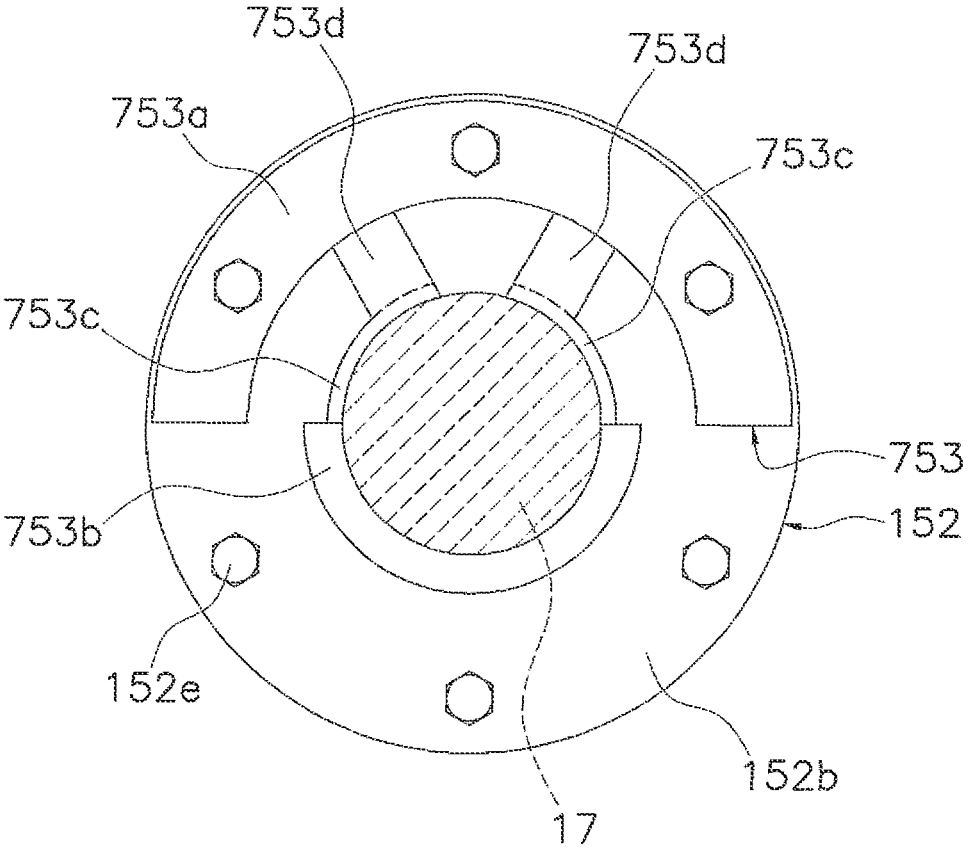
FIG. 10 is a bottom view of a rotor according to Modification E.

FIG. 10 is a bottom view of a rotor 152 to which a balance weight 753 according to a second modification of the balance weight 153 of the second embodiment is attached. The balance weight 653 is configured from a balance part 753*a*, a locking part 753*b*, a shaft-abutting part 753*c*, and two coupling parts 753*d*. The shaft-abutting part 753*c* has a portion having a thickness of zero. Specifically, the shaft-abutting part 753*c* is similar to the shaft-abutting part 253*c* of the third embodiment in that the shaft-abutting part 253*c* is configured such as to be partially incomplete along a circumferential direction of the crankshaft 17. Therefore, as shown in FIG. 10, the shaft-abutting part 753*c* is configured from two portions coupled with two circumferential end parts of the locking part 753*b*, respectively.

In the present embodiment, because the shaft-abutting part 753*c* is configured such as to be partially incomplete along the circumferential direction of the crankshaft 17, the shaft-abutting part 753*c* weighs less than the shaft-abutting parts of the first and second embodiments. Therefore, the mass of the balance weight 753 can be effectively minimized.

(6) Modification F

In the first embodiment, the balance weight 53 is attached to the lower end surface 52*b* of the rotor 52; however, the balance weight 53 may be attached to the upper end surface 52*a* of the rotor 52, or may be attached to both the upper end surface 52*a* and the lower end surface 52*b* of the rotor 52. The present modification can also he applied to the second embodiment, the third embodiment, and the previous modifications.

(7) Modification G

In the first through third embodiments, a scroll compressor 101 comprising a compression mechanism 15 configured from a fixed scroll component 24 and a movable scroll component 26 is used as a compressor; however, a compressor comprising another type of compression mechanism may be used. For example, a rotary-type compressor and/or a reciprocating compressor may be used. In the present modification as well, the balance weight of the first through third embodiments and the previous modifications is attached to an end surface of a rotor of a drive motor used in the compressor.

INDUSTRIAL APPLICABILITY

In the rotary machine according to the present invention, a balance weight can be reduced in weight while ensuring the strength thereof.

What is claimed is:

1. A rotary machine comprising:

a rotor;

a rotating shaft fixed to the rotor; and a balance weight fixed to the rotor, the balance weight having a balance part fixed to the rotor and positioned so as not to contact the rotating shaft, a locking part disposed on a side of the rotating shaft opposite from the balance part as viewed along an axial direction of the rotating shaft, the locking part being locked with the rotating shaft so as to limit movement of the balance part along a direction of centrifugal force generated by rotation of the rotor, a shaft-abutting part positioned between the rotating shaft and the balance part and coupled with the locking part, the shaft-abutting part contacting the rotating shaft, and a coupling part arranged and configured to couple the balance part and the shaft-abutting part, the balance weight being shaped such that a center of gravity of parts including the locking part, the shaft-abutting part, and the coupling part of the balance weight is coaxial with an axial center of the rotating shaft.

2. The rotary machine according to claim 1, wherein the rotor has a through-hole passing therethrough along the axial direction of the rotating shaft, and the coupling part couples the balance part and the shaft-abutting part so as not to overlap with the through-hole as viewed along the axial direction of the rotating shaft.

3. The rotary machine according to claim 2, wherein the shaft-abutting part is separated into two discontinued pieces.

4. The rotary machine according to claim 2, wherein a length of the balance part along the radial direction of the rotor is longer than a length of the locking part, a length of the shaft-abutting part, and a length of the coupling part along the radial direction of the rotor.

5. The rotary machine according to claim 1, wherein the balance part is fixed to the rotor at a fixing location, and the coupling part couples the balance part and the shaft-abutting part so that a virtual extension extending from the shaft-abutting part toward the balance part does not overlap with the fixing location as viewed along the axial direction of the rotating shaft.

6. The rotary machine according to claim 5, wherein the shaft-abutting part is separated into two discontinued pieces.

7. The rotary machine according to claim 5, wherein a length of the balance part along the radial direction of the rotor is longer than a length of the locking part, a length of the shaft-abutting part, and a length of the coupling part along the radial direction of the rotor.

8. The rotary machine according to claim 1, wherein the shaft-abutting part is separated into two discontinued pieces.

9. The rotary machine according to claim 1, wherein a length of the balance part along the radial direction of the rotor is longer than a length of the locking part, a length of the shaft-abutting part, and a length of the coupling part along the radial direction of the rotor.

10. The rotary machine according to claim 1, wherein a length of the locking part along a radial direction of the rotor is shorter than a radial distance of the rotor between the rotating shaft and the balance part, and a length of the shaft-abutting part along the radial direction of the rotor is shorter than the length of the locking part along the radial direction of the rotor.

11. A compressor comprising:

a rotary machine including a rotor;

a rotating shaft fixed to the rotor; and a balance weight fixed to the rotor, the balance weight having a balance part fixed to the rotor and positioned so as not to contact the rotating shaft, a locking part disposed on a side of the rotating shaft opposite from the balance part as viewed along an axial direction of the rotating shaft, the locking part being locked with the rotating shaft so as to limit movement of the balance part along a direction of centrifugal force generated by rotation of the rotor, a shaft-abutting part positioned between the rotating shaft and the balance part and coupled with the locking part, the shaft-abutting part contacting the rotating shaft, and a coupling part arranged and configured to couple the balance part and the shaft-abutting part, the balance weight being shaped such that a center of gravity of parts including the locking part, the shaft-abutting part, and the coupling part of the balance weight is coaxial with an axial center of the rotating shaft.

12. The compressor according to claim 11, wherein the rotor has a through-hole passing therethrough along the axial direction of the rotating shaft, and the coupling part couples the balance part and the shaft-abutting part so as not to overlap with the through-hole as viewed along the axial direction of the rotating shaft.

13. The compressor according to claim 11, wherein the balance part is fixed to the rotor at a fixing location, and the coupling part couples the balance part and the shaft-abutting part so that a virtual extension extending from the shaft-abutting part toward the balance part does not overlap with the fixing location as viewed along the axial direction of the rotating shaft.

* * * * *